US008667683B1

(12) United States Patent
Thomas et al.

(10) Patent No.: US 8,667,683 B1
(45) Date of Patent: Mar. 11, 2014

(54) APPARATUS AND METHODS FOR PERMANENTLY ASSEMBLING TUBES IN A HEAT EXCHANGER

(75) Inventors: David R. Thomas, York, PA (US); David A. Porter, Hanover, PA (US); Stefan A. Giese, Dallastown, PA (US); James M. Johns, Mount Joy, PA (US); Guy D. Newhouse, Millersville, PA (US); Debra A. Shank, Elizabethtown, PA (US); Duane E. Shickley, Elizabethtown, PA (US); Angela J. Wolfshuk, Ephrata, PA (US)

(73) Assignee: New Standard Corporation, York, PA (US)

( * ) Notice: Subject to any disclaimer, the term of this patent is extended or adjusted under 35 U.S.C. 154(b) by 1026 days.

(21) Appl. No.: 11/561,565

(22) Filed: Nov. 20, 2006

Related U.S. Application Data

(60) Provisional application No. 60/738,521, filed on Nov. 21, 2005.

(51) Int. Cl.
*B21D 53/02* (2006.01)

(52) U.S. Cl.
USPC ..... 29/890.03; 29/726; 29/726.5; 29/890.04; 29/890.045; 29/890.053

(58) Field of Classification Search
USPC ..... 29/726, 726.5, 890.03, 890.045, 29/890.04, 890.53
See application file for complete search history.

(56) References Cited

U.S. PATENT DOCUMENTS 2,410,140 A 10/1946 Young
2,581,121 A * 1/1952 McCurdy, Jr. et al. ..... 165/76
2,686,356 A * 8/1954 Wolosianski ..... 29/707
3,294,244 A * 12/1966 Laughlin ..... 211/41.1
3,534,862 A 10/1970 Shambelan
3,789,479 A * 2/1974 Zifferer et al. ..... 29/726
3,970,041 A 7/1976 Kircher
4,074,422 A 2/1978 Borjessom et al.
4,079,497 A 3/1978 Jernigan
4,221,299 A 9/1980 Taylor
4,319,951 A * 3/1982 Korbelak et al. ..... 156/502
4,405,012 A * 9/1983 Mach ..... 165/78
4,475,588 A * 10/1984 Tsou ..... 165/159
4,546,822 A * 10/1985 Tamura ..... 165/149
4,547,963 A * 10/1985 Ohmstede ..... 29/726
4,607,423 A * 8/1986 Sleep, Jr. ..... 29/890.043
4,785,518 A * 11/1988 Zifferer et al. ..... 29/281.1
4,828,021 A * 5/1989 Small ..... 165/162
5,228,191 A * 7/1993 Casterline ..... 29/726.5
5,241,749 A * 9/1993 Gentry ..... 29/890.043
7,849,598 B2 * 12/2010 Hsu ..... 29/890.032
7,856,716 B2 * 12/2010 Dixon ..... 29/890.051
8,087,134 B2 * 1/2012 Morley ..... 29/6.1

* cited by examiner

*Primary Examiner* — David Bryant
*Assistant Examiner* — Bayan Salone
(74) *Attorney, Agent, or Firm* — McNees Wallace & Nurick LLC

(57) ABSTRACT

Apparatus and methods for use with a baffle support fixture for a machine assembly of the tubes and baffles in a bundle assembly of a shell and tube type heat exchanger. The bundle comprises tubes inserted through baffles. The bundle is assembled using a holding fixture that includes anti-rotational features to secure baffles in a desired orientation. Following assembly, the bundle assembly is temporarily fixtured using pressure applying means such as plates and rods, and is then permanently affixed using an adhesive composition. After adhesive is applied, bundles, with the pressure applying means still attached, are preserved on racks and heat treated to cure and permanently set the adhesive.

11 Claims, 12 Drawing Sheets

APPARATUS AND METHODS FOR PERMANENTLY ASSEMBLING TUBES IN A HEAT EXCHANGER

CROSS-REFERENCE TO RELATED APPLICATIONS

This application claims priority to U.S. Provisional Patent Application Ser. No. 60/738,521 filed Nov. 21, 2005.

FIELD OF THE INVENTION

The present invention is directed to methods and apparatus for assembling and permanently fixturing the tubes and baffles of a shell and tube-type heat exchanger.

BACKGROUND OF THE INVENTION

Tube-type heat exchangers include a plurality of tubes of substantially uniform length and a plurality of truncated, perforated baffles through which the tubes pass. Such assembled tube and baffle arrangements are referred to herein as a "bundle assembly." Tube and baffle bundle assemblies can be assembled manually and/or automatically. Whether assembled manually, automatically, or by combination of manual and automatic methods, the resulting bundle assembly must conform to a predetermined desired shape, size, and configuration. This is because, after full assembly, the bundle assembly is typically inserted into a heat exchanger shell having predetermined fixed internal dimensions and overall length, such as in the shell of an oil cooler in a vehicle. Any significant deviation in the dimensions of the finished bundle assembly can prevent proper fit and proper function of the assembly within the heat exchanger shell.

Automatic tube assembly machines of the type with which this invention is used are illustrated in commonly owned U.S. Pat. Nos. 3,789,479 and 4,785,518. Such machines include, for example, a tube and baffle holding fixture mounted on a work table having capacity for selected vertical and horizontal movements. Two opposing sets of retractable guide rods advance successively selected quantities of tubes from a supply to the fixture, the individual rods of each set being aligned with corresponding rods of the opposing set. The machine includes means automatically operative to actuate the guide rods to advance the selected quantities of tubes from the supply to the fixture, means automatically operative to adjust the work table vertically and horizontally, following each transfer of tubes, to prepare for the transfer of the next selected quantity of tubes, and control means governing the movements of the guide rods and the work table. In this manner, tubes can be accurately and efficiently inserted to penetrate through one or more baffles in series, thereby forming a bundle assembly having a preselected configuration and dimension.

In some bundle assemblies, the perforated baffles are constituted of relatively thin, rigid metal sheets well adapted to withstand, without distortion of movement, the axial forces occurring as a result of the penetrations of the guide rods and the tubes back and forth through the baffle apertures during assembly of the bundle assembly. However, in some installations, it is preferred that the baffles be constituted of a non-metallic material, such as a relatively soft, pliable or flexible gasket-like composite material, referred to herein as "composite baffles", which is readily bendable or otherwise distortable when subjected to relatively minor degrees of force. In forming the perforations in such composite baffles, the dies utilized for stamping the perforations in metal baffles also are used for forming the perforations in the composite baffles. Following stamping, the perforations or holes in the composite baffles have a tendency to change diameter-wise. Such phenomenon, while not at all undesirable as far as the completed heat exchanger bundle assembly is concerned, renders difficult the assembly of its tubes and baffles.

Additionally, in some installations, it is preferred that the baffles be constituted of a tough, rigid, high-strength amorphous thermoplastic. Following molding of the baffle, the holes in the baffle have a tendency to change in a diameter-wise manner. In the case of amorphous thermoplastic baffles, the variation is generally predictable, and therefore, the baffle design includes holes that are oversized to accommodate the material movement without producing a surface to surface or interference fit with the tubes in the assembly process. Such phenomenon renders difficult the movement of in-process bundle assemblies in the manufacturing process and cured heat exchanger assemblies in transit between the heat exchanger assembly process, and also in the processes used to join the heat exchanger bundle assemblies with the shell.

Because of the flexible character of composite baffles, and because of the tendency of their perforations to dimensionally change, heat exchanger bundle assemblies incorporating such baffles are extremely difficult to assemble by machine and nearly impossible to assemble by hand. Because of the loose hole condition of the plastic baffles, and their effect on the dimensional and quality characteristics of the tube assembly product, bundle assemblies using plastic baffles are also difficult to fixture during the production process to match a predetermined configuration.

Additionally, once assembled, tube-type heat exchanger bundle assemblies, whether having metallic, plastic, and/or composite baffles, can easily become undesirably twisted or otherwise deformed from the desired predetermined configuration and dimensions, rendering them unsuitable for insertion into corresponding shell or housings to function as a heat exchanges such as an oil cooler, for example. Therefore, what is needed are assembly and fixturing apparatus and methods that will create and permanently preserve the desired configuration, shape and dimensions of a tube and baffle heat exchanger bundle assembly.

Lastly, it has been observed that vibration commonly encountered within a tube and baffle assembly within a heat exchanger casing may result in wear, and even cutting, of the tubes by the baffles. Thus, there is a further need for tube and baffle bundle assemblies that can withstand, and also attenuate, undesired vibrational contact between the tubes, baffles, and casing.

SUMMARY OF THE INVENTION

The primary object of this invention is to overcome the difficulties described above in assembling and permanently fixturing the tubes and baffles of a shell and tube-type heat exchanger to form a bundle assembly, whether having baffles constituted of a metal, plastic, composite, or any combination thereof.

A further object of the invention is to provide an improved baffle support fixture interchangeably useful for assembling, both manually and automatically, tubes and baffles in a bundle assembly, and that provides proper alignment of both complete and partial baffles in a desired orientation with the tubes, without undesired baffle rotation, and therefore permits the ready, efficient and quick assembly of the tubes in a bundle assembly having a plurality of complete and partial baffles disposed in a predetermined orientation with respect to one another.

A further object is to provide such an improved fixture apparatus which is adapted to be easily and quickly assembled and used, whether for manual assembly of tubes and baffles, or for installation and use on fixturing machines such as those described in U.S. Pat. Nos. 3,789,479 and 4,785,518, as well as for manual use and use with other known machines for assembling bundle assemblies, thereby enhancing the versatility and range of applicability of the fixturing apparatus.

A further object is to provide an improved baffle support fixture for assembling tubes in bundle assemblies having relatively soft and flexible baffles, as well as for use with rigid baffles, regardless of whether the baffles are composite, metal, or plastic, in which spaced vertical baffle support plates are utilized to stabilize the baffles and maintain their perforations in proper alignment during assembly of the tubes, regardless of whether assembly is by manual or automatic methods.

A further object is to provide improved apparatus and methods for permanently adhering individual rows and individual tubes to one another and to corresponding baffle portions, such as to ensure proper alignment during assembly of the tubes into the baffles, to reduce vibration and the undesirable effect of vibration. A still further object is to provide improved adhesive delivery apparatus and methods useful in performing the assembly and adhering methods.

Yet another object is to provide apparatus and methods for applying and curing of adhesive compositions useful in preserving a desired alignment and orientation of the tubes and baffles in an assembled tube and baffle bundle assembly to ensure that desired final dimensions are permanently preserved.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 13:
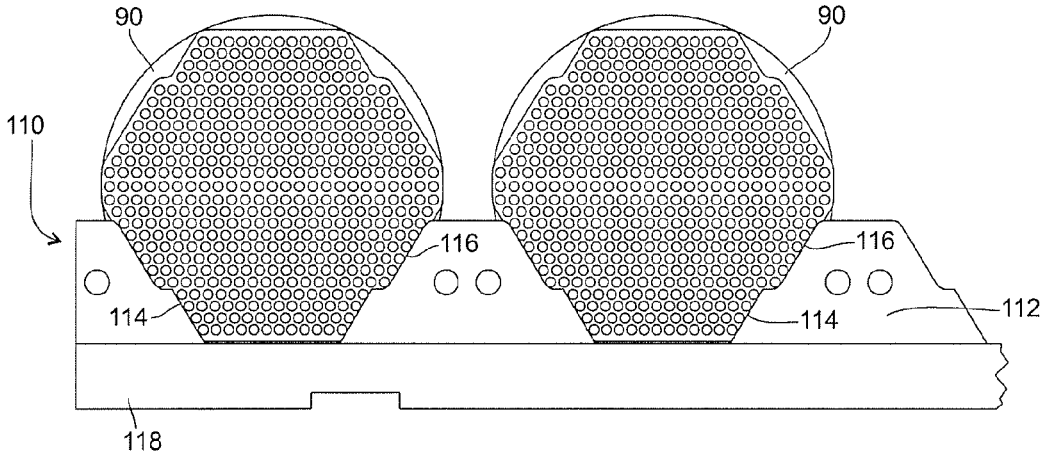
FIG. 13 is a side perspective view of a fixturing support of the present invention engaging a completed cylindrical tube and baffle bundle assembly.
Figure 14:
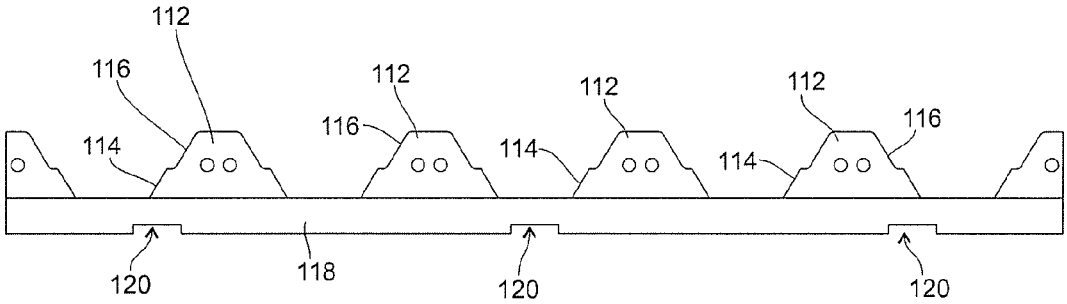
FIG. 14 is a side perspective view of the fixturing support of FIG. 13.
Figure 15:
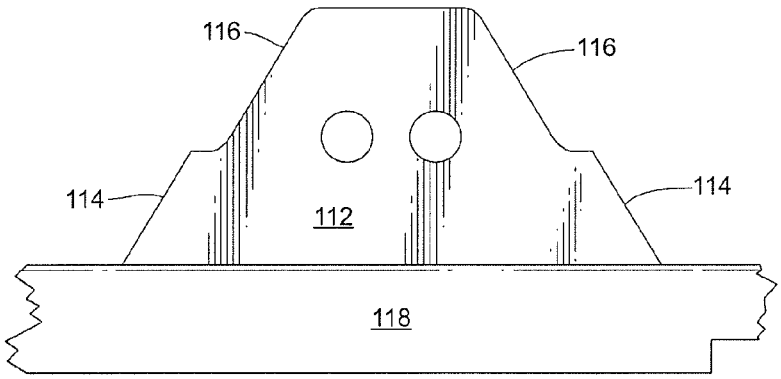
FIG. 15 is a close-up side perspective view of the fixturing support of FIGS. 12-13.

FIGS. 1-4 of the drawings illustrate the application of an embodiment of the fixture of this invention to the automatic tube assembly machine and assemblies illustrated in commonly owned U.S. Pat. Nos. 3,789,479, and 4,785,518. FIGS. 5-8 of the drawings illustrate an embodiment of the anti-rotational feature of the present invention for the baffle support of the fixturing apparatus of the present invention. FIGS. 9-12 of the drawings illustrate improved end plate and rod assemblies, as well as bundle assembly support apparatus, useful in assembling and permanently fixturing bundle assemblies in accordance with the present invention. FIGS. 13-15 of the drawings further illustrate bundle assembly support apparatus useful in assembling and permanently fixturing bundle assemblies in accordance with the present invention. FIGS. 16-19 of the drawings further illustrate improved apparatus useful in adhesively affixing tube and baffle bundle assemblies in accordance with the present invention. The drawings are illustrative, but not limiting, of the invention described herein.

Figure 1:
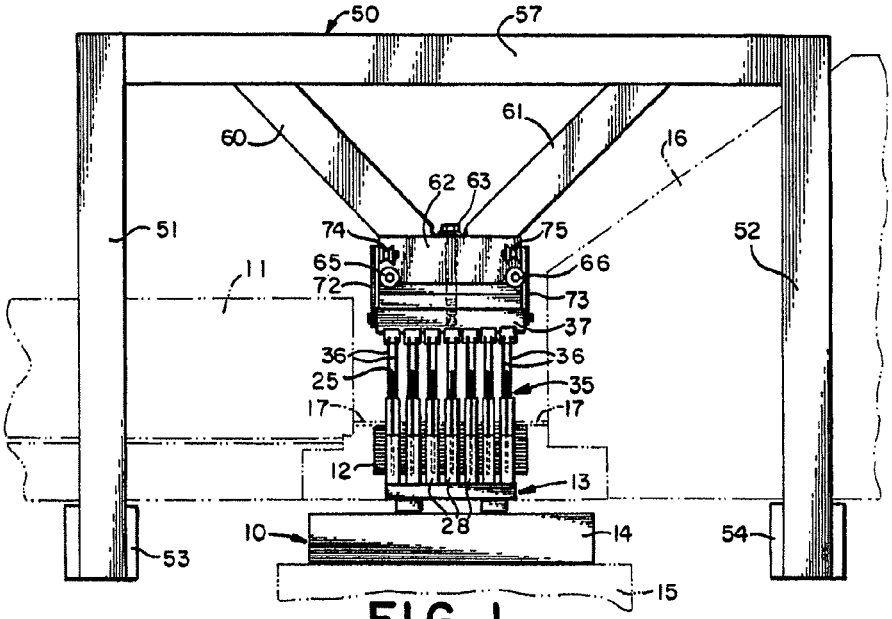
FIG. 1 is a fragmentary view in front elevation of an embodiment of a fixture of this invention installed on a prior art fixturing machine.
Figure 2:
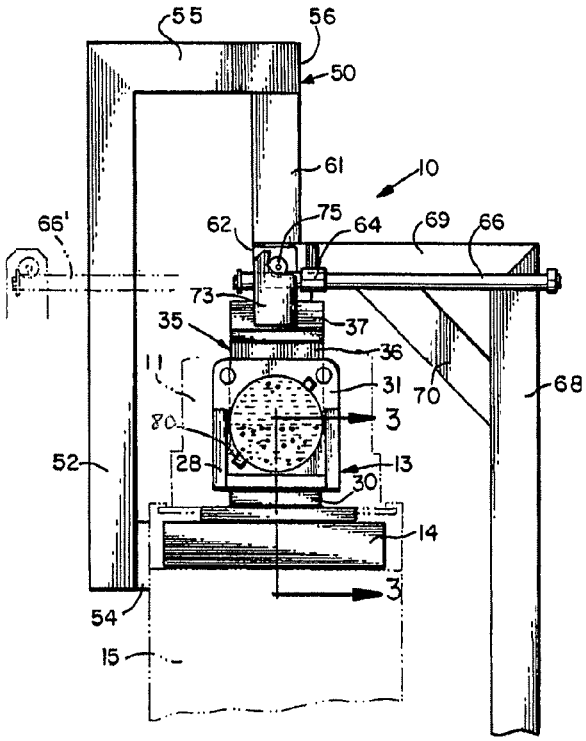
FIG. 2 is a fragmentary view in side elevation of the fixture shown in FIG. 1 installed on a prior art fixturing machine.
Figure 3:
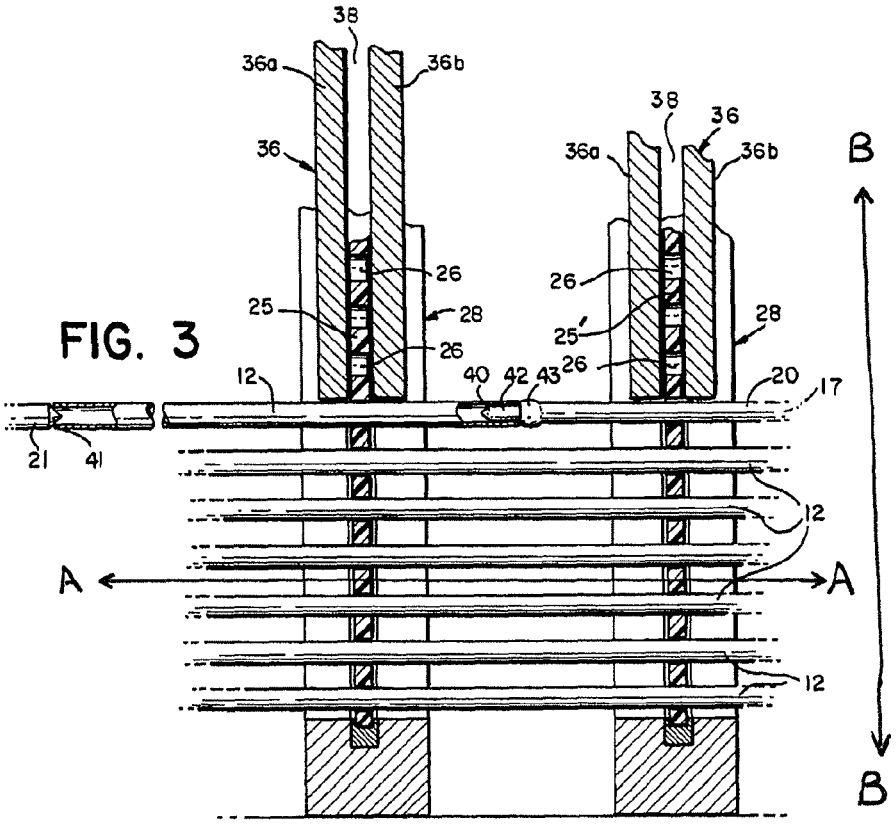
FIG. 3 is an enlarged fragmentary view of the fixture of FIG. 1 in section looking in the direction of the arrows 3-3 of FIG. 2.

Referring first to FIGS. 1, 2 and 3, a portion of a prior art automatic assembly machine 10 is illustrated, wherein there is shown in phantom the usual supply 11 of elongated tubes 12 used in a conventional shell and tube type heat exchanger. Also shown is an improved tube and baffle holding fixture 13 affixed securely to the top of the vertically and horizontally movable work table 14 below which appears in phantom the usual table supporting structure 15 containing the table actuating means. Also shown in phantom is the support structure 16 for the several horizontal, retractable probe rods 20 (shown in greater detail in FIG. 3) which cooperate with their several corresponding, axially aligned, horizontal and retractable insertion rods 21 to remove selected quantities of tubes 12 from the supply 11 and transfer them to, and position them properly in, the tube and baffle supporting fixture 13. The structure 16 also houses the actuating and control means for the probe rods 20. As explained in U.S. Pat. No. 3,789,479 and U.S. Pat. No. 4,785,518 aforesaid, selected rods 20 and 21 are advanced and retracted successively along the single horizontal working plane 17 to assemble the tubes 12 in successive horizontal rows in the improved fixture 13.

Figure 4:
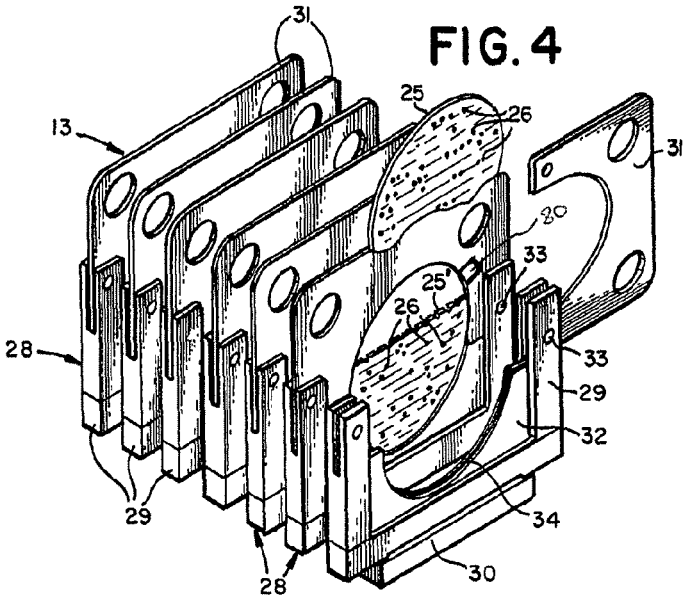
FIG. 4 is an enlarged view in perspective of the fixture of FIG. 1.

Reference now is made to FIG. 4, where the improved tube and baffle holding fixture 13 is illustrated in detail. Fixture 13 is constituted of a plurality of vertical, axially spaced, transverse, hollow supports 28 for mounting and retaining vertically the several axially spaced baffles 25, 25' which support the plural tubes 12 of the heat exchanger in proper spaced relation to each other. The baffles 25, 25' are of the usual perforated and truncated construction. They are provided with the usual horizontal rows 26 of spaced apertures, the apertures of each row being disposed in staggered relation to the apertures of their next adjacent rows. The baffles 25, 25' may be composed of rigid material such as metal, or alternatively may be constituted of a relatively soft, pliable or flexible material composed, for example, of a suitable rubber, plastic, composite, non-metallic material, or combinations or mixtures thereof.

As shown in FIG. 4, for example, each of the several transverse supports 28 for the baffles 25 includes a generally U-shaped base 29, each of which is fastened securely to a longitudinally extending bottom plate 30. The bottom plate 30 is secured to the movable work table 14, and functions to hold the tube and baffle supporting fixture 13 rigidly in place during assembly of the tubes 12 and baffles 25, 25'. Each base 29 supports a pair of vertically aligned or superimposed complemental concave components 31, 32 that function to receive and retain the baffles 25, 25'. Lower baffle retaining component 32 is fixed to its base 29, whereas the upper component 31 is removably engaged to the base 29. For example, the upper component 31 may engage the lower component 32 hingedly, pivotally, or otherwise removably connected to the base 29, such as by a pivot 33. By means of the pivots 33, each hinged upper baffle retaining component 31 may be swung to either an open or closed position, relative to its lower complemental component 32, as illustrated in FIG. 4. In other examples, the upper 31 and lower 32 components may be engaged by pins and slots, tongue and groove, friction fit, or other fastening means. When the two components 31, 32 are closed, their complemental concave areas form a circular or other desired hollow shape for receiving and retaining a baffle 25, 25' of a predetermined shape and size.

In one example as further shown in FIG. 4, the upper baffle support components 31 are opened to permit insertion of the baffles 25. When they are closed, the components 31, 32 function to retain the several longitudinally spaced baffles 25, 25' vertically, with the corresponding rows 26 of baffle apertures aligned horizontally. However, the rows of respective baffle apertures can be aligned at other than horizontal for inserting tubes, which may be beneficial to prevent fracture or other damage the baffles in machine assembly of a bundle, especially when inserting more than one tube 12 simultaneously. The corresponding apertures of the horizontally aligned rows are aligned axially to each other, whereby the tubes 12 may pass through the aligned apertures upon their transmittal to the fixture 13 by the guide rods 20, 21 (as shown in FIG. 3).

In an improvement contemplated herein, each support 28 is slidably adjustable along the bottom plate 30 to permit a user to accomplish a desired spacing between adjacent supports 28, thus permitting a desired predetermined spacing of baffles 25, 25'. In one embodiment, at least one base 29 of at least one support is slidably mounted to the bottom plate 30, with the base 29 and bottom plate 30 optionally further including means for securing the base 29 at a selected location and a selected orientation relative to the plate 30 and to other bases 29 of other supports 28. The means for securing can be any known fastening means, such as, by way of non-limiting example, set screws, tabs and corresponding grooves, spring-biased pins and corresponding apertures, and combinations thereof. The providing of such re-positionable supports 28 provides an advantage of simplifying the alignment of tube holes in each baffle 25, 25' in a series, as well as simplifying the insertion of tubes 12 through all baffles 25, 25' in the series. For example, where a proposed tube and baffles assembly will involve many baffles 25, 25', the supports 28 can be positioned in very close proximity to one another to provide closely spaced baffles 25, 25' having minimal distance therebetween, which may provide improved alignment of baffle holes by preventing an inserted tube 12 from drooping before reaching the next baffle in the series. Upon completion of insertion of all tubes through all baffles, each support 28 may then repositioned to yield a desired baffle spacing, such as by sequentially disengaging the securing means between a base 29 and the plate 30, then sliding the base 29, along with the support 29 and baffle 25, along the base 30 and the tubes until the baffle is at the desired spaced location on the assembly.

Figure 8:
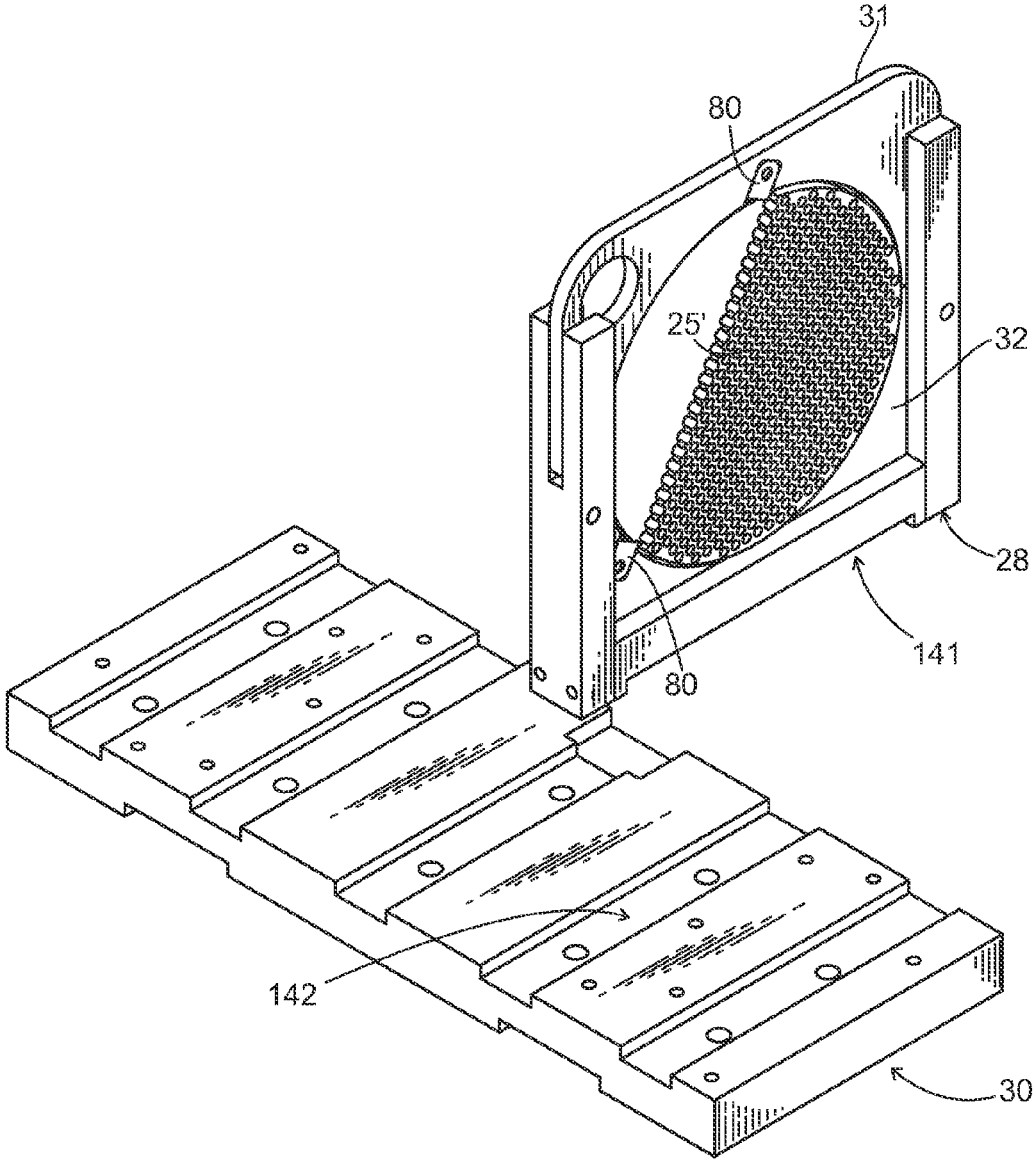
FIG. 8 is a side perspective view of a third embodiment of the baffle support fixture having multiple anti-rotate assemblies.
Figure 9:
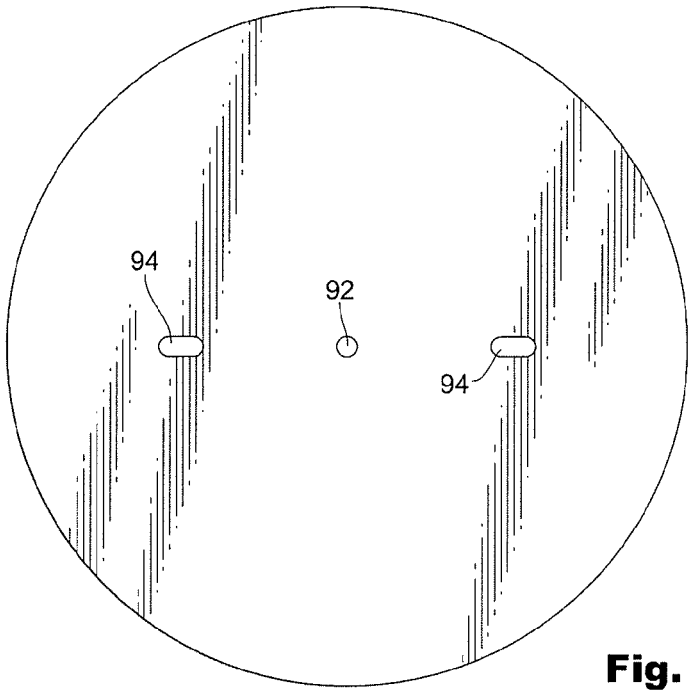
FIG. 9 is a side perspective view of an end plate of the present invention.

As shown in FIG. 8, in another improvement contemplated herein is a modular fixturing method; each support 141 is interlocked with a groove 142 in the base plate 30 to permit a user to accomplish a desired spacing between adjacent supports, as well as vertical and horizontal alignment through all baffles in the fixture 13. The baffle support plates can be made, singularly or in sets, for differing baffle spacings and product diameters. Baffle supports 28 can be made in multiple configurations and joined with the mounting plate 30 to the desired configuration to produce the product. The means for joining of the baffle supports 28 to the plate 30 by way of a non-limiting example, can be accomplished using set screws, tabs and corresponding grooves, spring-biased pins and corresponding apertures, and combinations thereof. However, any known fastener can be used for joining the baffle supports 28 to the plate 30.

Figure 5:
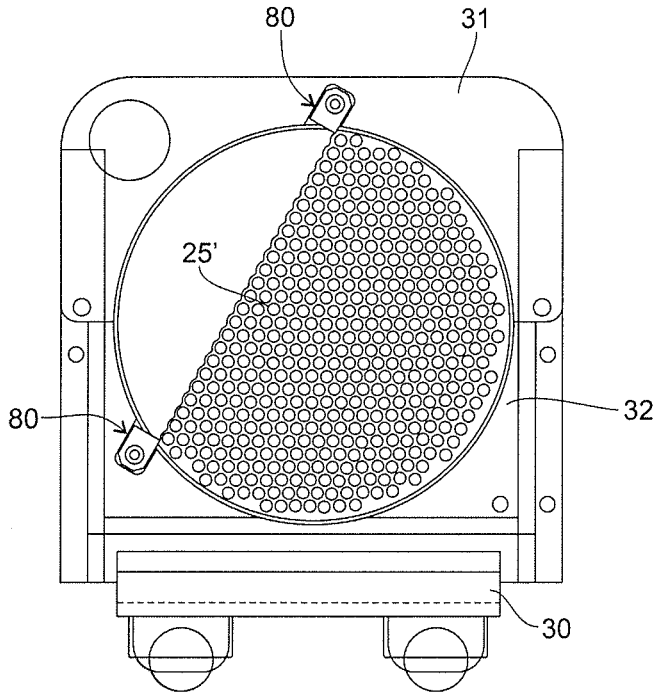
FIG. 5 is a partial cross-sectional side view of the fixture of FIG. 1 having a plurality of anti-rotate assemblies.
Figure 6:
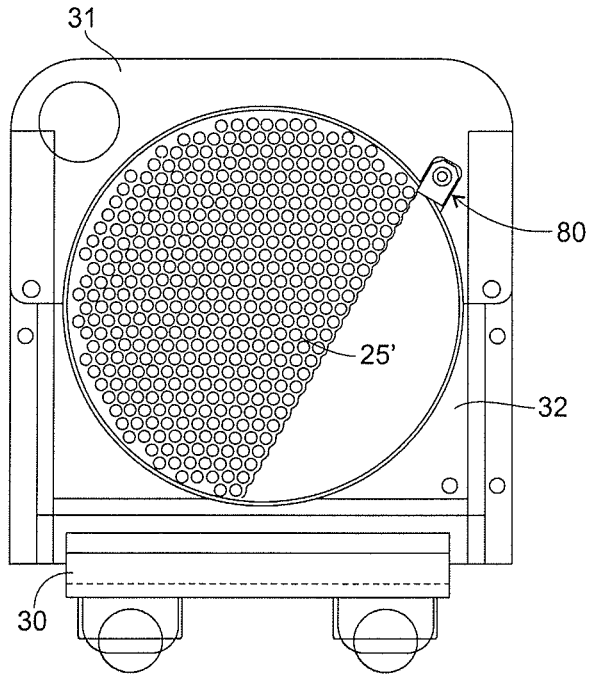
FIG. 6 is a partial cross-sectional side view of a second embodiment of the fixture of FIG. 1 having a single anti-rotate assembly.
Figure 7:
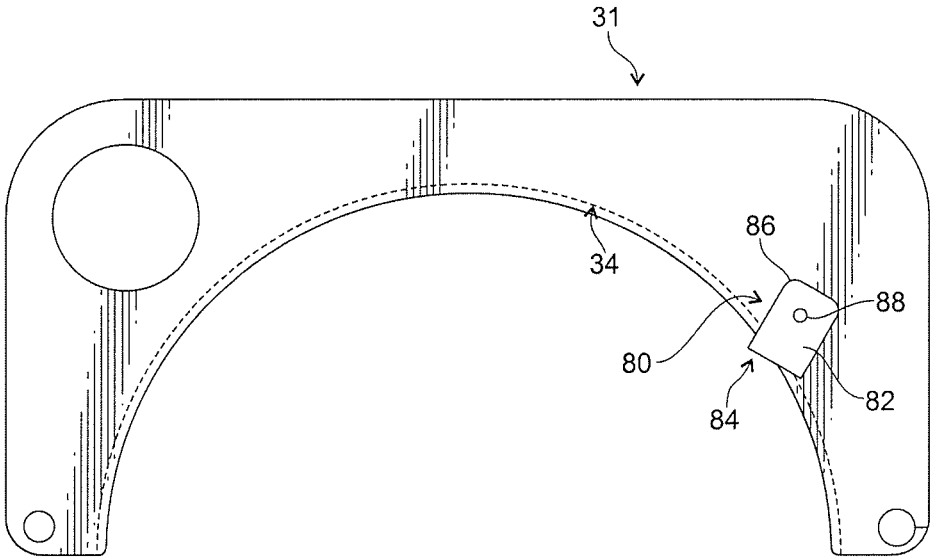
FIG. 7 is a partial cross-sectional side view of an upper baffle support component of the fixture having a single anti-rotate assembly.

As further shown in FIGS. 5-8, the upper baffle support 31 and/or the lower baffle support 32 may include features that secure a desired alignment of each whole baffle 25 and partial baffle 25' within a series of baffles 25, 25', and that prevent undesired rotation of the installed baffles 25, 25'. For example, as shown in FIGS. 5-7, the anti-rotational feature may include a protruding tab assembly 80, as further described herein. That embodiment is particularly suited to permitting use of baffles of varying diameter and/or peripheral edge geometry since the amount of protrusion can be adjusted to engage a selected portion of a baffle edge. However, as further described herein, alternative anti-rotational structures are contemplated, including but not limited to upper or lower baffle portions having protruding tabs, end walls, pins, clamps, and other anti-rotational structures disposed and configured so as to position and maintain the desired alignment of a baffle 25 or partial baffle 25' within a series of baffles provided in a fixture support 35 for assembling of a tube and baffle heat exchanger assembly.

As shown in FIGS. 5-8, it is often desirable to provide a tube-type heat exchanger assembly wherein at least some of the baffles 25 are partial baffles 25'. In the examples of FIGS. 5-6, baffles 25 are provided as substantially whole circles, and the partial baffles 25' are semicircular, having an arcuate edge and an opposite truncated edge. However, the invention is equally applicable to baffles 25, 25' of any selected geometry, including but not limited to oval, triangular, square, rectangular, pentagonal, hexagonal, heptagonal, octagonal, nonal, decahedron, among others. By way of non-limiting example, in a cylindrical tube-type heat exchanger assembly, it may be desirable to utilize circular baffles 25 at the end locations, with semicircular baffles 25' provided at predetermined locations between each end circular baffle 25. Upon full assembly of tubes 12 into each aperture 26 of each baffle 25, and through any corresponding aperture in each partial baffle 25' of such an assembly, fluid will be able to flow between the tubes 12, as well as through the unbaffled space provided at the truncated edge of each partial baffle 25' location, thus providing a desired flow pattern through the assembly. More preferably, the assembly will include a series of partial baffles 25' having their truncated edges rotationally offset from one another, so as to create a spiral flow of fluid through each section of the tube assembly defined by the baffles 25, 25'. For example, the truncated edge of partial baffle 25' of FIG. 5 is rotationally offset 180 degrees from the partial baffle 25' of FIG. 6. However, as can be appreciated, any desired rotational or other alignment offset of baffles 25, 25' can be accomplished by the apparatus and methods of the invention.

In order to prevent undesired rotation of a partial baffle 25' during fixture assembly and during tube installation, an anti-rotational assembly 80 is provided. As shown in FIGS. 5-8, in one embodiment, the assembly 80 includes a tab body 82 having a protruding end 84 and an opposite mounted end 86. The protruding end is disposed to as to engage the truncated edge of a partial baffle 25', without interfering with the insertion of any tubes 12 through the truncated portion and corresponding apertures on other baffles 25, 25' in the tube and baffle assembly. In the embodiment of FIG. 5, an anti-rotational assembly 80 is provided in both the upper baffle support 31 and the lower baffle support 32, with the location of each assembly such that each assembly 80 engages the truncated edge of the partial baffle. However, as shown in FIG. 6, a single anti-rotational assembly 80 may provide acceptable results when located in either the upper baffle support 31 or in the lower baffle support 32. Any number and combination of anti-rotational assemblies 80 may be provided to produce the desired result. The assembly 80 is preferably removably mounted into the baffle support 31, 32 to allow flexible and interchangeable use of the supports 31, 32 at various locations, with or without assemblies 80. As shown in FIG. 7, preferably, each baffle support 31, 32 includes a recessed groove into which the tab body 82 can be inserted, mounted end 86 first, so that the protruding edge 84 is at a desired position. The mounted end 86 can then be secured by removable fastening means such as a screw, bolt and nut, pin, or other fastening means known to those skilled in the art. Preferably, the tab body 82 includes an aperture adjacent the mounted end 86, with the baffle support 31, 32 having a corresponding aperture 88 through which fastening means can be threaded to secure the tab body 82 in a desired position. The aperture 88 provided in the tab body 82, and any corresponding apertures provided in the baffle supports 31, 32, may be any shape, but are preferably slotted so as to allow for adjustment of the protrusion of the protruding end 84 into the groove 34 by adjustment of tension exerted by the fastening means.

Alternative anti-rotational assemblies 80 are contemplated herein, including but not limited to any dimensional feature that can be provided in an upper support 31 or lower support 32 to engage a portion of a baffle. For example, protruding tabs or pins may be provided that selectively engage the edge of a baffle 25 and/or engage at least one hole of a baffle 25 to maintain a desired orientation of the baffle 25, and to resist rotation of the baffle 25 about an axis parallel to the longitudinal axis of a tube or the desired central longitudinal axis A-A of the tube and baffle assembly to be manufactured. Alternative anti-rotational features include end walls and/or obstruction provided in the groove of the upper support 31 or lower support 32, as well as opposed tabs or clamps provided on either support 31, 32. Additionally or alternatively, an indentation can be produced in or through the baffle at its outer perimeter or circumference, such as a scallop or divot, that allows for a pin, screw, tab, or other locating device to engage and position the baffle within the fixture to maintain proper rotational orientation. Also, since amorphous plastic baffles can be produced through the use of plastic molding technology, the hole walls in the baffle may include a draft angle, which means that the walls of the hole may be tapered so that the molded part may be ejected from the mold. Since a tapered hole can be used assist the insertion of tubes or assembly rods through the bundle in both automatic or manual assembly processes, maintaining consistency of the direction of the taper can be advantageous in the assembly process, and therefore, a scallop or divot in only one side of the baffle with a pin, screw, tab, or other locating device to control the draft angle of holes when baffles are loaded into the fixture to improve the assembly process. Each anti-rotational feature 80 is disposed and configured so as to position and maintain the desired alignment of a baffle 25 or partial baffle 25' within a series of baffles provided in a fixture support 35 for assembling of a tube and baffle heat exchanger assembly.

In automatic machine assembly methods of using the fixturing assembly 35, and as shown in FIG. 4, the several transverse supports 28 retain the succession of baffles 25 in alternating inverse order. Alternate supports 28 retain alternate baffles 25 in their lower support portions 32, with the horizontal truncated edges of the baffles facing upwardly. The intervening baffles 25, 25' are supported in the upper portions 31 of the intervening supports 28, with their horizontal truncated edges facing downward. To aid in retaining the baffles 25, 25' in proper alignment, the concave edges of the lower support components 32 may be provided with arcuate grooves 34. The arcuate edges of the lower, alternate baffles nest within the grooves 34, whereas only the lower edge portions of the upper, intervening baffles are engaged within the grooves. Additionally, an anti-rotational assembly 80 may be provided to ensure desired alignment of each baffle. For example, as previously described, in one embodiment the anti-rotational assembly 80 may include a protruding end 84 that extends beyond the groove 34 and beyond the concave edge of the baffle support 31, 32 to engage the truncated edge of a partial baffle 25'. Alternatively or additionally, the protruding end 84 may extend minimally into the groove 34 but not beyond the concave edge of the baffle support 31, 32 to engage the arcuate edge of a whole baffle 25 or partial baffle 25' inserted into the groove 34. However, other anti-rotational structures contemplated herein can be used. For example, the anti-rotation feature can be any of tabs, protrusions, end walls and/or obstructions provided in the groove 34 of the support plate 31, 32, as well as clamps, pins, screws, bolts, and combinations thereof.

In order to maintain the baffles 25, 25' in proper vertical alignment relative to each other, with their corresponding apertures aligned axially during penetration by the probe rods 20 as they advance to the tube supply 11, and during the retraction of those rods in cooperation with the advancing insertion rods 21, to transmit tubes 12 to the baffle supporting fixture 13 for insertion through the rows 26 of baffle apertures, a baffle stabilizing fixture 35 may be provided, as illustrated in FIGS. 1 and 2. The baffle stabilizing fixture 35 is constituted of a plurality of longitudinally spaced pairs 36 of rigid, vertical, closely spaced, transverse plates **36*a*, 36*b* (FIG. 3) which are secured to, and depend from, a horizontal master plate 37. The individual plates 36*a*, 36*b* of each depending pair 36 of baffle support plates preferably are constituted of unperforated thin sheet metal, and are disposed transversely relative to the machine 10 and its tube and baffle holding fixture 13. Their width is substantially equal to the diametrical width of the hollows of the baffle supports 28 (FIG. 2**). Their upper or proximal ends are affixed to the master plate by any suitable securing means, such as bolted brackets, welding, etc.

The imperforate plates 36*a*, 36*b* are closely spaced relative to each other, and define therebetween narrow vertical spaces or slots 38 which are slightly wider than the thickness of the two vertically aligned elements 31, 32 of the baffle supports 28 of the fixture 13. By way of example, for baffles 25, 25' on the order of 0.1" in thickness, the components 31, 32 of the baffle supports 28 may be 0.2" in thickness and the spacing between each pair of baffle support plates 36*a*, 36*b* may be on the order of 0.21" in width. The distal ends of the plates 36*a*, 36*b* of each pair of plates 36 define or provide openings for the reception or insertion of the baffles 25, 25' into the vertical slots or spaces 38.

As illustrated in FIG. 3, during tube assembly the individual baffle support plates 36*a*, 36*b* of each pair 36 of such plates are disposed parallel to, and on opposite sides of, one of the vertical baffles 25 supported by the hollow transverse supports 28 of the fixture 13. The lower horizontal edges of the distal ends of the depending baffle plates 36*a*, 36*b* always are disposed immediately above the guide rods 20, 21, i.e. above the working plane 17 (FIG. 1), so as to provide clearance for the rods and the tubes 12 during each tube insertion cycle of the machine 10. This is accomplished by controlling selectively the movement of the work table 14 following each tube insertion cycle. Because of the relatively small clearances, the pairs of plates 36 narrowly straddle or envelop their respective baffles 25, 25' above the working plane 17, and thus are operative to stabilize the baffles, and retain them and their apertures in alignment during each tube insertion cycle of the machine 10.

More specifically, as the probe rods 20 advance to the tube supply 11, passing through the tube and baffle support fixture 13 and the baffle apertures aligned in the working plane 17, the pairs of plates 36 support the baffles 25, 25' against bending or distortion, thus maintaining their verticality. Likewise, upon retraction of the guide rods 20 from the tube supply 11, in cooperation with the advancing insertion rods 21 to transmit the tubes 12 to the fixture 13, the pairs of plates 36 function to stabilize and maintain the verticality of the baffles 25, 25' as the tubes pass through their apertures.

The forward ends 40, 41, respectively, of the guide rods 20, 21 preferably are of the usual conical configuration to permit their limited entry into the open ends of the tubes 12. Such construction ensures the firm gripping of the tubes 12 by the rods 20, 13 and ensures that the rod and the tube are accurately aligned longitudinally to each other 21 during transmittal of the tubes through the fixture. Additionally, to facilitate passage of the guide rods 20, 21 and the tubes 12 through the apertures in the soft, pliable baffles 25, 25', each forward end 40 of a probe rod 20 has an axial length or segment 42 of reduced diameter, the inner portion of which merges into an enlarged, ball-shaped protuberance 43. The decreased diameters of the distal ends 40 of the probe rods 20 reduce friction and the degree of pressure asserted against the soft baffles 25, 25' when those rods penetrate the apertures of successive baffles 25 as they advance to the supply 11. Further, the ball-like protuberances 43 on the guide rods 20, upon retraction of those rods from the tube supply 11, function to enlarge slightly the apertures of the baffles 25, 25' as they pass therethrough, thereby increasing clearance for the tubes 12 advancing from the supply 11 and passing through the baffles 25. Additionally, due to the dimensional changes to the perforated holes in pierced baffles, a lubrication system that places a film of lubricant on the rods may be added to the assembly equipment to decrease friction between the rods as they pass through the baffles.

In automatic machine assembly apparatus and methods, the baffle stabilizing fixture 35 is supported and maintained in position relative to the machine 10 by a rigid superstructure indicated generally by the reference numeral 50 (FIGS. 1, 2). Superstructure 50 includes a pair of horizontally spaced, vertical standards 51, 52 which, at their lower ends, are affixed at horizontally spaced locations to the front of the machine 10 by any suitable securing or fastening means 53, 54.

As best shown in FIG. 2, the upper end of vertical standard 52 is provided with a right-angled horizontal arm 55 that extends over and inwardly relative to the machine 10. Horizontal arm 55 terminates in a distal end 56 at a location spaced vertically above the longitudinal axis of the machine 10. Standard 51 is of identical construction to standard 52, having an inwardly extending, right-angled horizontal arm terminating in a distal end at a comparable location relative to the machine 10.

An elevated horizontal beam 57 extends longitudinally of the machine 10, and is connected to and supported by the horizontally spaced distal ends of the two standards 51, 52. Extending vertically downward from beam 57 are a pair of inclined, converging support arms 60, 61 which, at their junction, merge into a support bracket 62 of generally rectangular, box-like configuration. Support bracket 62 supports a pair of longitudinally spaced, hollow support bearings for mounting slidably a pair of spaced, cylindrical, axially slidable, transverse bars 65, 66. As illustrated in FIG. 2, bar 66 is supported horizontally and slidably by circular bearing 64 affixed to the support bracket 62, whereby transverse bar 66 may be advanced axially to the forward position illustrated in phantom at 66', and may be retracted rearwardly to its solid line position. A circular bearing identical in construction to bearing 64 is affixed to the opposite side of bracket 62, and supports slidably the horizontally movable transverse bar 65, whereby that bar also may be advanced and retracted relative to the machine 10 in the same manner as bar 66.

If desired, superstructure 50 also may include a third vertical standard 68 located at the rear of the machine 10 and secured to the floor on which the machine rests. Standard 68 is provided with a right-angled horizontal arm 69 that extends inwardly of the machine and connects to the support bracket 62, thereby further stabilizing the rigidity of the superstructure 50. An inclined support brace 70, extending between standard 68 and its horizontal arm 69, may be provided to add further stability to the supporting structure 50.

The baffle support fixture 35 is secured in operative position relative to the tube and baffle support fixture 13 by a vertical bolt 63 extending downwardly through a central bore in support bracket 62. As illustrated in FIG. 1, threads formed on the lower end of the bolt 63 engage within a correspondingly threaded hole formed in the horizontal master plate 37. When bolt 63 is fully engaged threadingly with plate 37, fixture 35 is clamped securely to support bracket 62, and thus maintained at a fixed location relative to fixture 13 during tube assembly. When the fixtures 35, 13 are thus located vertically relative to each other, as shown in FIGS. 1 and 2, each pair 36 of baffle support plates 36*a*, 36*b* straddles one of the baffles 25, 25' above the working plane 17 of the machine, in the manner illustrated in FIG. 3.

The selected vertical and horizontal movements of the work table 14, during assembly of the tubes 12 in the fixture 13, are carried out by an actuating mechanism (not shown) of the type disclosed in U.S. Pat. No. 3,789,479 aforesaid. The table actuating means is operative to change automatically the position of the tube and baffle holding fixture 13 relative to the tube supply 11 and the guide rods 20, 21, following each deposit of tubes 12 in the fixture 13, preparatory to the next deposit of tubes therein. At the outset of the operation of the machine 10, before any tubes 12 have been deposited in fixture 13, the work table 14 is fully elevated relative to the machine and to the stationary baffle support fixture 35.

When work table 14 is fully elevated relative to fixture 35, the pairs 36 of baffle plates 36*a*, 36*b* substantially fully straddle or envelop their respective baffles 25, 25'. In such position, the working plane 17 is coincident with the lowermost rows 26 of baffle apertures, such rows being horizontally aligned, as explained previously. In practice, when the work table 14 is at its uppermost position, with the two fixtures 13, 35 properly aligned, approximately 3/16" of the lowermost portions of the baffles 25, 25' are exposed between the distal ends of the plates 36*a*, 36*b* and the bottom portions of the concave surfaces of the lower baffle support components 32.

As the tube assembling operation of the machine 10 proceeds, work table 14 is caused to descend vertically by successive incremental distances sufficient to bring each succeeding row 26 of baffle apertures into the working plane 17 of the machine, following which the guide rods 20, 21 deposit the selected number of tubes 12 in the aligned apertures disposed in the working plane. With each downward movement of the work table 14, a corresponding and incremental horizontal movement is imparted to the work table 14. Such movements compensate for the staggered relationship between the baffle apertures, and ensure that, in each successive adjustment of the rows 26 of the baffles 25, 25' into the working plane 17, their apertures are properly aligned axially with the guide rods 20, 21.

A highly important advantage of this invention resides in the fact that the baffle stabilizing fixture 35 may be used manually, and may additionally or alternatively be readily installed on and removed from, an automatic assembly machine. For example, when in use on the machine 10, the fixture 35 can be installed and removed without disrupting its capacity for assembling the tubes 12 in a heat exchanger irrespective whether its baffles 25, 25' are made of metal or of a non-metallic material, and irrespective of whether the tubes are inserted from one direction, alternate directions, and whether the tubes are inserted individually, in groups of multiple tubes simultaneously. For example, this may be achieved by the horizontal support bars 65, 66 mounted slidably internally of their respective circular bearings, illustrated by bearing 64 in FIG. 2.

Affixed to the longitudinally spaced ends of the master plate 37 are a pair of horizontally spaced, upwardly extending, vertical arms 72, 73. Extending inwardly from the upper ends of the vertical arms 72, 73, respectively, are grooved rotatable bearings 74, 75. The two roller bearings 74, 75 are spaced apart longitudinally, and are disposed, respectively, above the horizontally slidable bars 65, 66. By reason of their grooved construction, the rotatable roller bearings or wheels 74, 75 are adapted to rest on the horizontal bars 65, 66, with capacity for rolling movement thereon, incidental to installing the fixture 35 on, or removing it from, the tube assembly machine 10.

If it is desired to remove the fixture 35, in order to utilize machine 10 for assembling metallic baffles in heat exchangers, one need only remove the threaded bolt 63, whereby fixture 35 may be lowered so that its rollers 74, 75 come into contact with, and are supported by, the horizontal bars 65, 66. With the fixture 35 now supported by bars 65, 66, the bars may be advanced slidably outwardly of the machine, to the position indicated by reference numeral 66' in FIG. 2, whereupon the fixture 35 is rolled out to their forward ends and then manually elevated and removed. Thereupon, the support rods 65, 66 may be pushed back, transversely relative to the machine, to their full line position illustrated in FIG. 2, following which the machine is ready for use in assembling metallic baffles. The slidable relationship between support bars 65, 66 and their respective support bearings enables the quick and easy removal and replacement of the baffle support fixture 35 in the machine 10 as required.

Thus, the superstructure 50, by means of its inclined support arms 60, 61, bracket 62 and threaded bolt 63, provides a fixed supporting structure for retaining the baffle support fixture 35 in operative position relative to the tube and baffle support fixture 13 and its selectively movable work table 14. By reason of the threaded bolt 63, the horizontally slidable support bars 65, 66 and the rotatable support wheels 74, 75, the fixture 35 may be quickly assembled with the machine 10, or quickly disassembled therefrom, as required.

Permanent Fixturing of Bundle Assemblies.

Once insertion of all tubes 12 into all baffles 25, 25' is completed, it is critically important that the tube and baffle assembly remain in its desired alignment in all dimensions. For example, as shown in FIG. 3, one desired alignment is with all tubes 12 substantially longitudinally parallel to one another, with the longitudinal axis of each tube 12 parallel to a central longitudinal axis (A-A) of the bundle assembly. Furthermore, it is desirable that the central plane (B-B) of each baffle 25, 25' be substantially parallel to the central plane of the other baffles, and that the plane B-B be substantially perpendicular to the central longitudinal axis A-A of the bundle assembly. Thus, in cases involving straight tubes 12, regardless of the outermost geometrical shape of the tube and baffle assembly, it is desirable that each tube 12 be substantially perpendicularly disposed relative to each baffle 25, 25' through which it passes, and furthermore that each baffle 25, 25' remains substantially perpendicular to the tubes 12 passing through it and substantially parallel to all other baffles.

The present invention provides apparatus and methods to ensure that the desired alignments of all tubes 12 and baffles 25, 25' are maintained, whether during assembly and containment within the fixture 35, as well as upon removal of the tube and baffle assembly from the fixture 35, and in further processing and use of the assembly. In the present invention, end plates are used to engage and secure the tubes 12 in their desired alignment, thereby also maintaining the baffles 25 in their respective desired alignment. However, "end plates" as used herein can include any structure or apparatus that maintains the end of a bundle assembly in a predetermined alignment. In one example, the present invention contemplates several types of end plates, with the only common requirement being that each end plate include surface features for engaging at least one selected tube, and/or at least one selected baffle holes and tubes 12, in a manner that prevents undesired motion of at least one tube 12 relative to another tube 12. In one example shown in FIGS. 9-12, an end plate 90 is placed at each end of a bundle assembly, and each end plate 90 includes at least one substantially flat face for engaging the end of at least one tube 12 in an assembly, thereby sandwiching the bundle assembly. As further described herein, pressure applying means, such as a rod 97 threaded through holes in each end plate 90 and through the bundle assembly, are used to apply pressure along the central axis A-A (as represented by the longitudinal axis of rod 97), thereby aligning the ends of all tubes 12 in the assembly. In an alternate embodiment, an end plate 90 may have a plurality of protruding dowels that engage the end of at least one pre-selected tube 12, or which dowel pins engage at least one pre-selected baffle holes having no tube 12 inserted therethrough, and combinations thereof. Alternatively or additionally, the end plates may have raised surfaces that correspond with the desired outer cross-sectional geometry of the tube and baffle assembly, the surfaces configured and disposed so as to engage at least some of the tubes on the outermost periphery of the assembly to maintain a desired alignment and configuration of the tubes 12. In yet another alternate embodiment, the end plate 90 may additionally or alternatively have a recessed surface portion that is a negative impression of the desired geometry of the tube and baffle assembly, which surface may optionally include raised portions that engage wither the inner channel of at least one tube 12 and/or that protrude into the interstitial spaces between multiple tubes 12.

As further described herein, the end plates 90 are configured so as to exert pressure on the opposite ends of the tubes 12, the force applied along the axis A-A of the tube assembly sufficient to permit movement, such as rotation of the entire tube and baffle assembly about the axis A-A, facilitating bundle alignment without adversely altering the desired alignment of any tube 12 or baffle 25, 25' in the assembly. Also, as previously described, the end plates 90 can be used to for parallel orientation of the end plane of the bundle assembly and the baffle closest to the end plane of the bundle assembly by using the plane of the end plate 90 (consistent with baffle axis B-B shown in FIG. 3) as a common plane for the end of the bundle and locational tabs of the fixture 13. The use of end plates in any embodiment will thus permit the bundle assembly to be rotated about the axis A-A, whether horizontally, vertically, or otherwise, to permit the controlled application of an adhesive composition to permanently adhere the tubes 12 to the baffles 25, 25'.

In one embodiment shown in FIGS. 9, 13, 17, and 19, an end plate 90 is provided having multiple apertures 92, 94 for receiving alignment rods 95, 97. Each aperture 92, 94 corresponds to the open end of at least one tube 12. In one embodiment, to preserve alignment, pressure applying means in the form of a center alignment rod 97 is threaded through the center aperture 92 of a first end plate 90, through the corresponding tube 12, and through the center aperture 92 of a second end plate located at the opposite end of the tube and baffle assembly (not shown), thereby forming a sandwich. Each end of the center rod 97 is then secured by a fastener 99. For example, the fastener 99 may be an open nut that allows a rod to pass through it, and therefore can be continuously tightened as it travels down a threaded portion of the center rod 97. An exemplary open nut-type fastener is the open wing nut shown in FIGS. 9-10. Other fasteners include clamps, quick nuts, welds, bumps, protrusions, and other means suitable for providing a stop at a selected position on a longitudinal rod or similar pressure applying structure.

Figure 10:
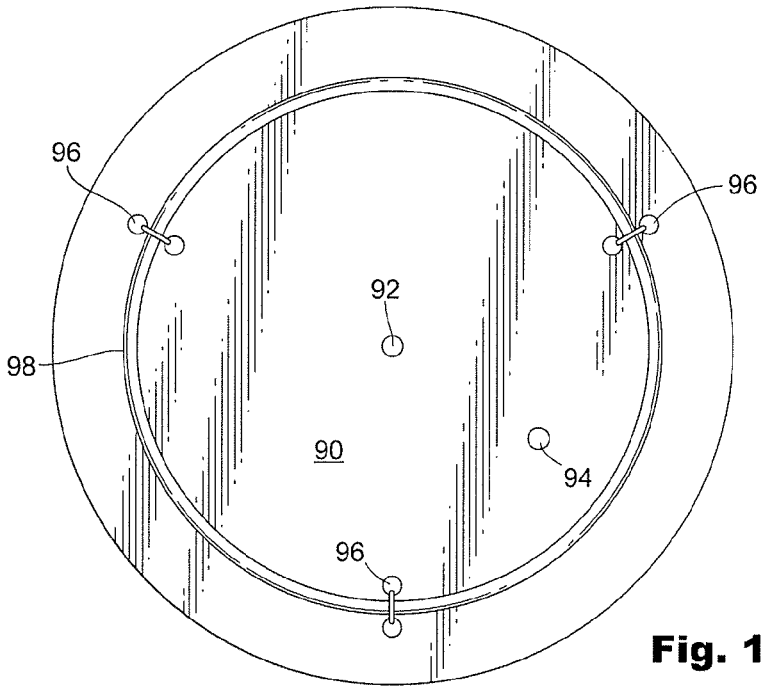
FIG. 10 is a side perspective view of an end plate in a second embodiment of the present invention.

Next, a horizontal alignment rod 95 is threaded through a second horizontal alignment aperture 94 provided in the first end plate 90, through the corresponding tube 12, and through the corresponding horizontal alignment aperture in the second end plate (not shown). A second horizontal alignment rod 95' is threaded through another horizontal alignment aperture 96, through the corresponding tube 12, and through the horizontal alignment aperture 96' in the second end plate 90'. A fastener 99 is optionally applied to each of the rods 97, 95, 95' and is tightened to maintain each plate 90 in pressured contact with the ends of at least some of the tubes 12. Optionally, as shown in FIG. 10, a cushion element 98, such as an elastomeric ring, sheet, or other deformable material may be provided between two or more end plates 90 placed together at an end of a bundle assembly, thus permitting the innermost plate 90 to move as necessary to accommodate thermal expansion of the tubes 12 during heat curing of the adhesive. Such thermal expansion, if not attenuated or otherwise accommodated, can cause helical twisting of the bundle or other dimensional distortion of the bundle such as loss of perpendicularity of the end plane of the bundle with the centerline of the bundle. The side of the plate 90 opposite the cushion element 98 is placed in contact with the end of the tubes 12 in the bundle assembly. In addition to attenuating pressure from heat expansion of the bundle during heat curing, use of a cushion element 98 may further reduce damage to the ends of the tubes 12 that might result from tightening of the fastener(s) on the rods, as well as from any impact damage that might otherwise result during adhesive application, racking, and other post-assembly fixturing processing. Where heat curing is contemplated, the cushion element 98 should be selected to withstand anticipated temperatures, pressure loads, and other environmental conditions of the curing process.

Figure 11:
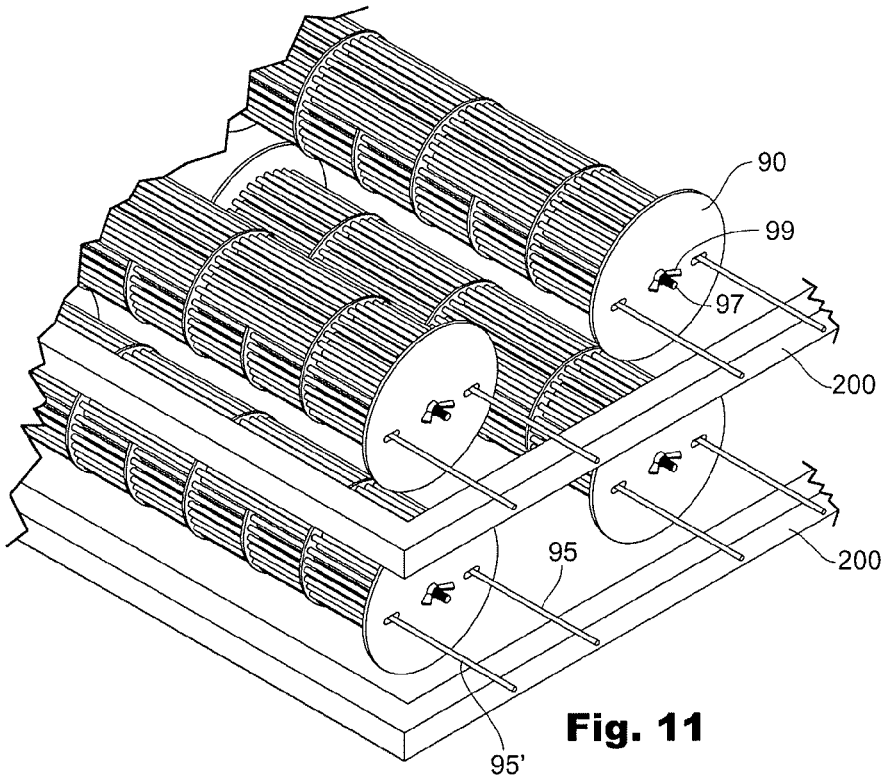
FIG. 11 is a side perspective view of the end plate of FIG. 8 installed on a tube and baffle bundle assembly of the present invention.
Figure 12:
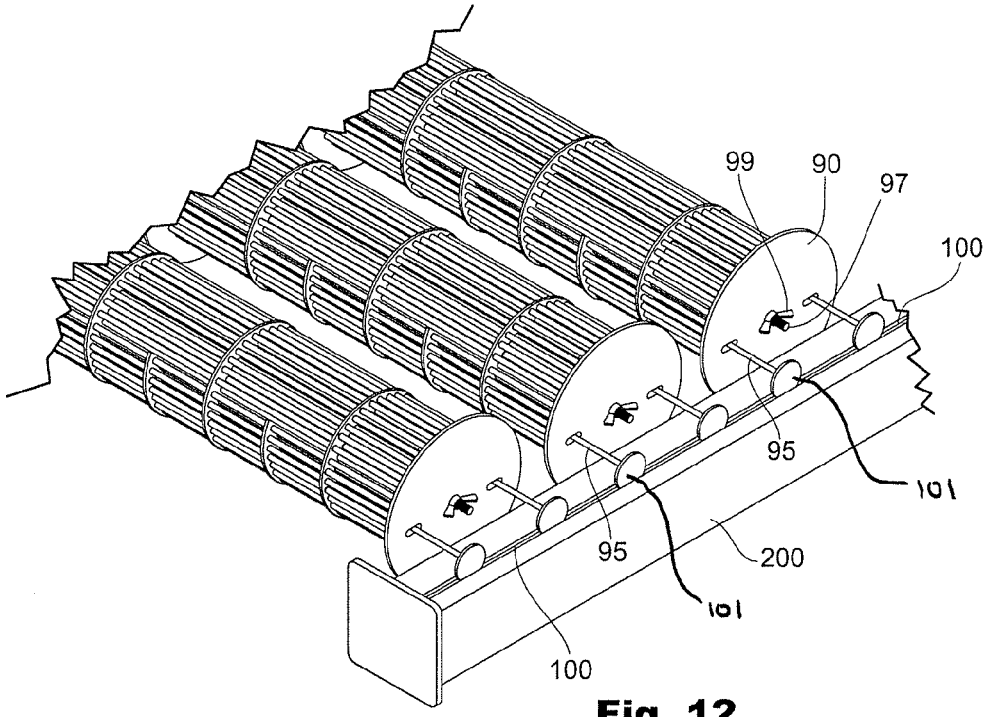
FIG. 12 is a side perspective view of the end plate of FIG. 8 installed on a tube and baffle assembly showing the alignment rods and rack assembly of the present invention.

As shown in FIG. 11, the rods 95, 95' are long enough to protrude from both end plates 90. The protruding ends are useful to support the assembly in post-assembly processing, particularly during racking of the assembly prior to heat treatment to permanently set the adhesive, as further described herein. As shown in FIG. 10, preferably, one end of each rod 95, 95' includes a fastener that is a disk 101 having its radius oriented substantially perpendicular to the longitudinal axis of the rod 95, 95'. The disk 101 allows the rod 95, 95' to engage a slot 100 provided in a rack assembly 200 so that the rack assembly 200 can be moved without dislodging the assembled bundle assemblies, and simultaneously assures proper parallel alignment of the rods 95, 95' with respect to each other by preventing twisting of the bundle assemblies.

As shown in FIGS. 13-15, fixturing supports 110 are also provided to preserve alignment of the assembled bundle assemblies. Such supports 110 can be used at any stage of fixturing, and are especially useful to maintain desired alignment in conjunction with an end plate assembly prior to heat treatment as necessary to permanently set the adhesive, as well as during cooling after heat treatment. The supports 110 may further protect the assembly from damage during storage inspection, and material handling operations by minimizing torsional stress on the bundle assembly that could possibly cause misalignment. FIG. 13 illustrates a preferred embodiment of the fixture support 110 installed on a rack assembly 200 and engaging a cylindrical bundle assembly. Notably, the vertical members 112 include stepped portions that engage the tubes at critical locations to prevent sagging and twisting of the tubes, while the horizontal base member 118 securely engages the longitudinal horizontal members of the rack assembly 200. As further shown in FIGS. 14-15, the support 110 includes a plurality of vertical members 112 in a series, each vertical member attached to the horizontal base member 118 of the support 110. Each vertical member 112 has a generally triangular front profile, and includes opposite base edges 114 and opposite stepped edges 116. The spacing between each vertical member 112 on the horizontal base member 118, as well as the height and shape of each edge 114 and 116, is determined by the size and geometry of the tube and baffle assemblies that will be supported thereon. Preferably, the horizontal base member 118 includes features to secure the support 110 to the longitudinal members of a rack assembly 200, the base member 118 being substantially perpendicularly aligned with the longitudinal members of the rack assembly 200. Accordingly, the base member 118 preferably includes notches 120 that engage each longitudinal member of a rack assembly 200. However, the base member 118 may additionally or alternatively utilize known attachment apparatus such as screws, bolts, welds, rivets, and other known fastening means to securely engage the longitudinal members of a rack assembly 200.

Figure 16A:
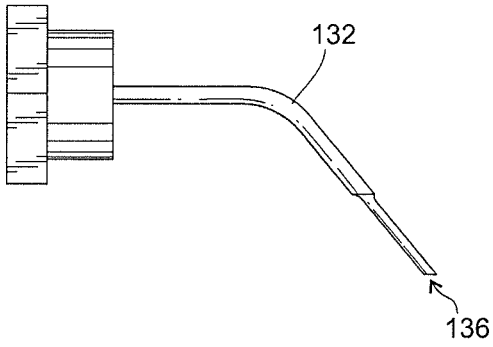
FIG. 16*a-c* are side, top, and front perspective views of an adhesive dispensing tool of the present invention.
Figure 16B:
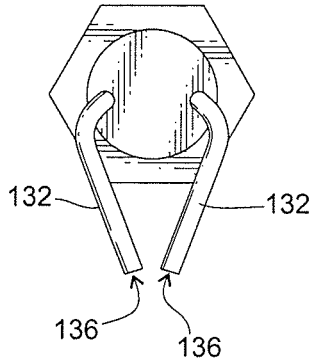
Figure 16C:
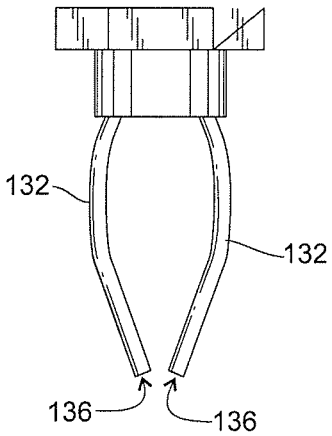
Figure 17:
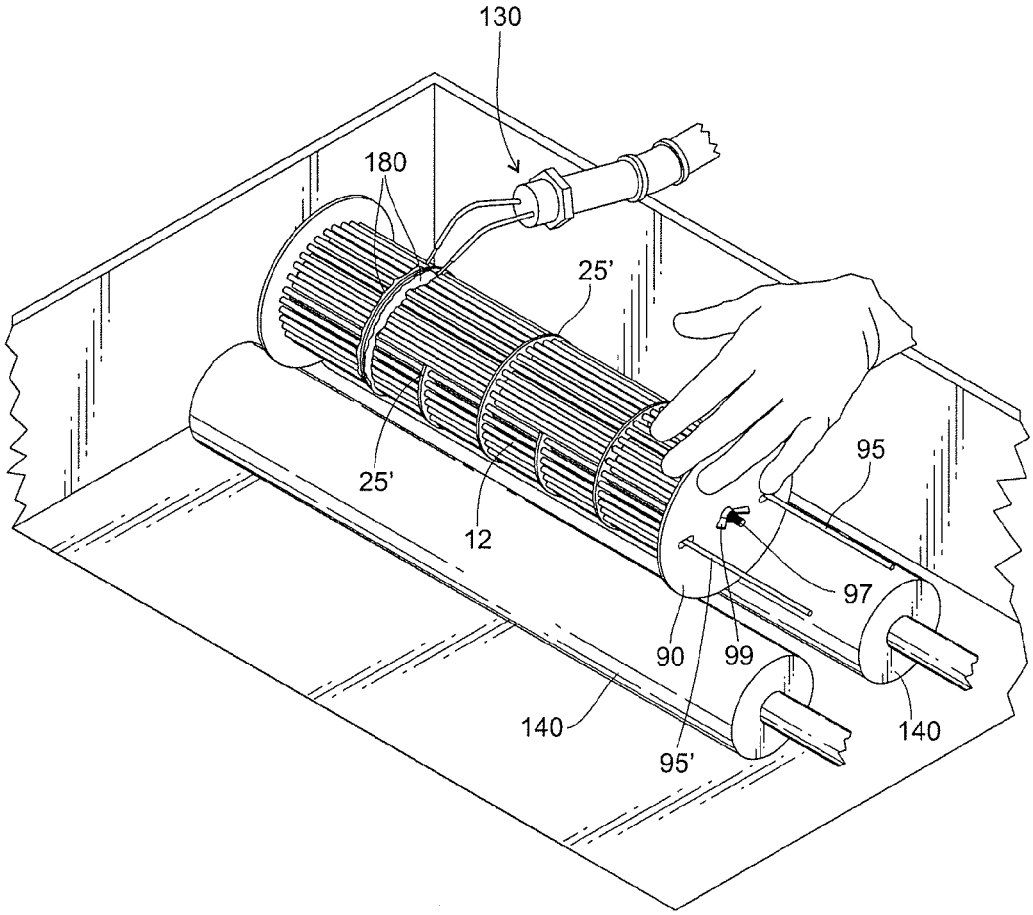
FIG. 17 is a side perspective view of the tool of FIG. 16*a-c* in use to dispense adhesive onto a cylindrical tube and baffle assembly.
Figure 18:
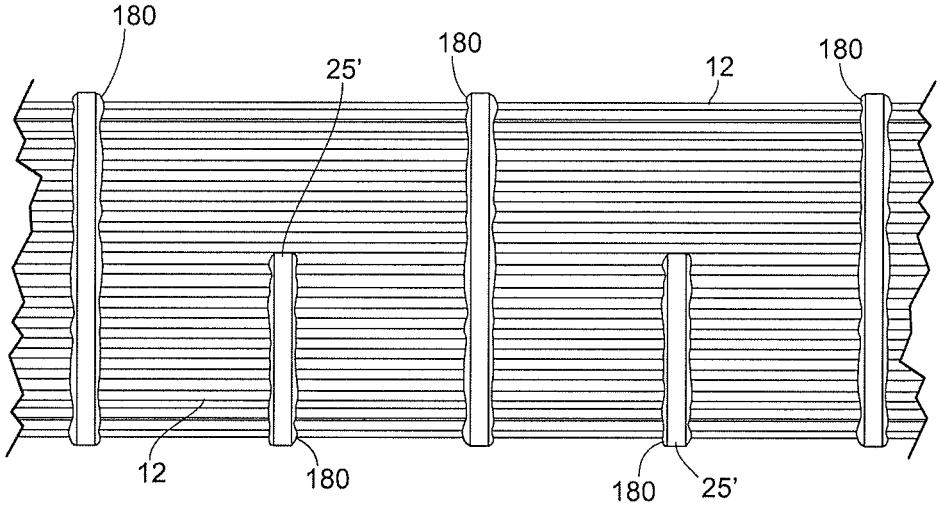
FIG. 18 is a side view of the cylindrical tube and baffle assembly of FIG. 17 upon completion of adhesive dispensing.
Figure 19:
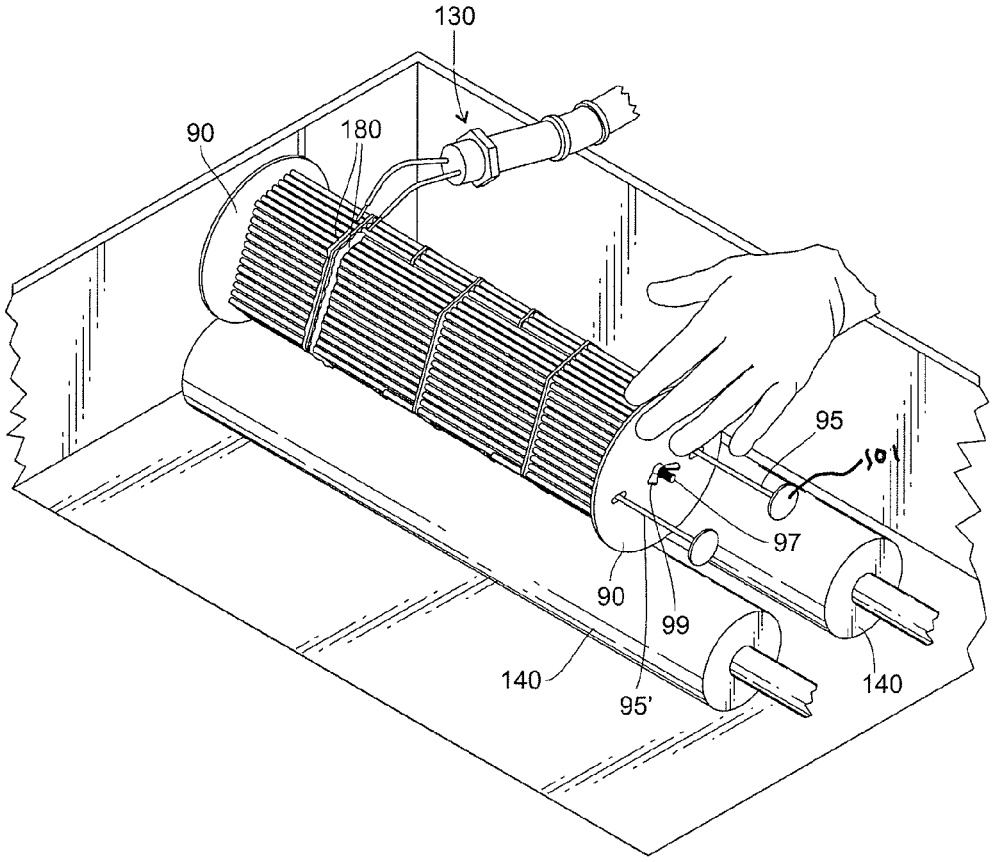
FIG. 19 is a side perspective view of the tool of FIGS. 16*a-c* in use to dispense adhesive onto a non-cylindrical tube and baffle assembly.

FIGS. 16-19 illustrate apparatus of the present invention useful in methods of permanently adhering tubes and baffles in a bundle assembly. In particular, FIGS. 16*a*-16*c* illustrate an embodiment of a multiple-pronged adhesive applicator 130 used to apply an adhesive composition to the tubes and/or baffles of a bundle assembly. The exemplary applicator 130 includes a first hollow dispensing nozzles 132 and a second hollow dispensing nozzle 134, the dispensing nozzles each having an open end 136 for dispensing an adhesive composition. As shown in FIG. 16, the dispensing nozzle ends 136 are spaced apart a sufficient distance from one another so as to permit a baffle 25, 25' to fit in the space provided between the dispensing nozzles 132, 134. As further shown in FIG. 16, the nozzle ends 136 are preferably cut at an angle of less than 90 degrees, and more preferably at an angle of between 30 and 70 degrees. In another embodiment, the ends of the cylindrical tubes are also flattened into an oval configuration so as to provide a substantially flat bead of adhesive for application at the joint of the tube 12 and the baffle 25, 25'. As shown in FIGS. 17 and 19, the arrangement of the applicator 130 in the preferred embodiment of FIGS. 16*a*-16*c* ensures that the nozzle ends 136 will protrude a sufficient distance into the interstitial space between each tube 12 to allow adhesive to be deposited substantially around the circumferential perimeter of each tube 12, regardless of the shape of the tube 12. Particularly where the adhesive 180 is a thixotropic adhesive, it may be desirable to modify the dispensing end of the nozzle 136 to direct the flow of adhesive 180 to the intersection of the tubes 12 and baffles 25, 25'. For example, the tip of the nozzle 136 may include a compound angle to permit desirable contact with both the tubes 12 and baffles 25, 25'. Additionally, the assembly may include one or more nozzles 136, whether single, paired, or otherwise configured.

The apparatus of FIGS. 16*a*-16*c* can be used to practice the methods illustrated in FIG. 17 and FIG. 19. FIG. 17 shows the preferred apparatus and method applied to a cylindrical tube and baffle assembly, while FIG. 18 shows the preferred apparatus and method applied to a non-cylindrical (hexagonal) tube and baffle assembly. FIG. 18 shows a completed circular tube and baffle assembly adhered using the preferred applicator 130, adhesive, and methods described herein.

Using the methods of the present invention, the apparatus of FIGS. 16*a*-16*c* is used to apply adhesive to an assembled bundle assembly. Notably, the assemblies illustrated in FIG. 17 and FIG. 19 include the end plate 90 and rod 95, 95', 97 assemblies previously described herein. Upon assembly of the tubes 12 into the baffles 25, 25', whether by hand or through use of a fixturing machine as previously described herein, and before removing the bundle assembly from any fixture 13 apparatus, at least one end plate 90 is applied to each end of the bundle assembly, and pressure applying means such as rods 95, 95' and 97 are inserted and securely fastened as previously described herein. For example, a first end plate 90 is applied by first threading a thin rod 97 through a first hole 92 provided in the first end plate 90, the threaded thin rod protruding through a corresponding tube 12, and through a corresponding hole 97 provided in an opposite end plate (not shown). This process may be repeated to insert additional rods 95, 95' through at additional apertures 94, 96 at preselected locations. In one example, the rods and apertures are provided at mirror image locations of each end plate 90. However, locations of apertures 92, 94, and 96 may be asymmetrical. Once threaded, fastening means 99, such as open wing nuts or the like, are mounted on the rods to squeeze the end plates against the tubes 12, thereby holding the tubes in parallel relation to one another, and to orient and maintain the baffles 25, 25 in perpendicular relation to the tubes 12. As shown in FIG. 8, the end plate 90 may optionally include an elastomeric member 98 for cushioning contact, or for preventing direct contact, the contact between the end plate 90 and selected tube 12 ends. The size, shape, composition, and hole configuration of the end plate 90 and elastomeric member 98 may be adjusted within the spirit of the invention so as to ensure desired contact with various shapes and sizes of tube and baffle assemblies. Once mounted, the end plates 90 and rods 95, 95', 97 serve as supports to allow further processing and handling of the assembly while preserving the desired assembly shape. However, the end plates 90 must be removed for proper functioning of the tubes in a heat exchanger, so permanent fixturing is required before the end plates 90 and rods 95, 95', 97 can be removed.

In a method using end plates 90 and other apparatus of the invention, as illustrated in FIG. 17 and FIG. 19, permanent fixturing methods involve securing the assembly using end plates, followed by rotation of the assembly about the longitudinal axis A-A, and dispensing and application of an adhesive composition so as to permanently adhere at least the peripheral tubes 12 to at least one baffle 25.

In the example of FIGS. 17-19, the method is performed by placing the tube and baffle assembly, with end plates 90 attached thereto as previously described herein, on a surface such as the respective arcuate surface of dual opposed parallel rollers 140 so that only the outer peripheral edge of the end plates 90 touch the surface of the roller 140. The assembly can thus be freely rotated about the axis A-A so as to sequentially expose the entire perimeter of each baffle 25, 25' in the assembly, as well as the outermost tubes 12 at their point of intersection with each baffle 25, 25'. The operator places an adhesive applicator 130 in close proximity to the baffle 25, 25' so that at least one nozzle 132, 134 straddles the baffle 25, 25' and can be made to protrude into the interstitial spaces between the tubes 12 while still remaining in close contact with both sides of the baffle 25, 25'. The applicator 130 is activated so that an adhesive composition 180 is dispensed in a controlled manner simultaneously through each nozzle opening 136. The tube and baffle assembly is rotated on the opposed rollers 140 as pressure is simultaneously exerted to press the nozzle openings 136 against the tubes 12 and adjacent baffle portions 25, 25'. Ideally, the rate of rotation about axis A-A and the rate of dispensing are such that the rotation causes the applicator 130 to be sequentially moved from one interstitial space across the periphery of each tube 12 to the next interstitial space, with only slight, if any, movement of the applicator 130 itself. The coordination of the rate and timing of rotation versus dispensing, as well as the non-expanding nature of the adhesive 180, is important so that a sufficient amount of adhesive is dispensed so as to fill the interstitial space and also to contact the adjacent baffle 25, 25' and tube 12 walls, but not to overdeposit any adhesive 180. This is because in most applications, the baffles 25, 25' are sized so that their maximum diameter matches exactly with the inner diameter of a corresponding housing, such as a cast iron oil cooler housing. If too much adhesive 180 is deposited, the adhesive 180 may protrude over the peripheral edge of the baffle 25, 25', undesirably increasing the bundle assembly dimension.

Each nozzle 132, 134 is connected to an adhesive supply source, preferably a common adhesive reservoir (not shown)

provided in the applicator 130. Optionally, the adhesive reservoir may be supplied by a hose connection to an adhesive pump to allow for continuous resupply to the reservoir, thereby permitting extended adhesive application without the need to periodically manually refill the reservoir. All nozzle dimensions and ribbon dimensions are based upon 60-100 psig. Because the viscosity of the adhesive changes with the type selected as well as with its temperature, the temperature and operating pressure of the pail pump may be adjusted to compensate for variation in viscosity.

| | Nozzle Dimensions | | Adhesive Ribbon Dimensions | |
|---|---|---|---|---|
| | Width | Height | Width | Height |
| 1 | .08" | .04" | 1.5 mm | .8 mm |
| 2 | .12" | .06" | 1.8 mm | .9 mm |
| 3 | .15" | .09" | 2.1 mm | 1.1 mm |
| 4 | .21" | .15" | 2.7 mm | 1.2 mm |

By way of further example, in addition to the nozzle configuration, delivery rate, and rotation rate, selection of the adhesive 180 is an important aspect to practice of the present invention to yield a properly aligned and properly dimensioned tube and baffle bundle assembly, and without undesirable human and environmental hazards. The inventors have found that fast-setting, non-expanding or minimal-expanding adhesives may be used to produce desirable results. For example, while nitrile rubber adhesives have been known for use in some tube assembly fixturing, rubber-based adhesives are runny and stringy, and do not set adequately to lend structural support until heat cured. Moreover rubber-nitrile adhesives contain hazardous solvents, and also require use of organic solvents for cleanup. Moreover, known nitrile rubber adhesives have been found to be an inadequate adhesive agent to prevent twisting or otherwise ensuring dimensional and orientational parameters of an assembly are maintained while awaiting heat treatment of the assembly. These characteristics all contribute to nitrile rubber compounds being undesirable to ensure reliable, safe, convenient, permanent fixturing of desired dimensions for tube and baffle assemblies used in close-tolerance heat exchanger applications.

The inventors have found that thixotropic adhesives, when properly cured by the inventive methods herein, provide an unexpected yet measurably improved performance in permanent adhesive fixturing of tube and baffle bundle assemblies. For example, Henkel Loctite HYSOL® brand epoxy adhesive provided excellent flow, adhesion to copper and composite tubes and baffles, without expanding, sagging, or running HYSOL® is a registered trademark of Henkel Loctite Corporation, Rocky Hill, Conn. 06067 for proprietary adhesive formulations. In particular, HYSOL® Product 9432NA (hereinafter "Product 9432NA") was selected for use in an example of the present invention because it is pumpable, requires no mixing, is non-sagging and paste-like, and exhibits high chemical and temperature resistance after heat curing, such as at oven temperatures below 400 degrees F., to result in the adhesive reaching a core temperature of at least 200 degrees F. Additionally, despite being specified for aluminum and steel, after heat curing, Product 9432NA was surprisingly found to have excellent tensile strength, adhesion, hardness, and shear strength when applied to non-etched copper tubes, copper nickel tubes, and stainless steel tubes, and also to metal, plastic, and composite baffles, and combinations thereof. In its uncured form, Product 9432NA is a proprietary epoxy adhesive having the following manufacturer's specification:

| Ingredient | CAS No. | Weight Percent |
|---|---|---|
| Epoxy resin | 25068-38-6 | 40-70 |
| Epotuf 37-051 | Proprietary | 1-5 |
| Guanidine derivative | Proprietary | 3-7 |
| Epoxy resin | 54208-63-8 | 1-5 |
| Aluminum | 7429-90-5 | 10-30 |
| Glass | 65997-17-3 | 1-5 |
| Modified silicon dioxide | 67762-90-7 | 3-7 |

Upon application as previously described herein, thixotropic epoxy adhesives such as Product 9432NA envelope the tube 12, adhering it to the adjacent tube and well as to any adjacent baffle portion, forming a heat-curable composition that is ultimately durable, vibration resistant, and structurally sound. In most applications, the use of an adhesive bead 180 having a width of from about 1 mm to about 5 mm and a height of about 1 mm to about 2 mm is desirable to produce a cured and adhered tube and baffle bundle assembly that meets predetermined dimensional criteria, such as to fit within a housing having a corresponding internal size.

After curing by heat treatment, the adhered assembly as shown in FIG. 18, including the cured adhesive composition 180, is durable, non-twistable, and precisely and permanently preserved in its desired alignment. While Product 9432NA was used in this example, the inventors have contemplated that other epoxy-based, non-expanding or minimally expanding adhesives may also be suitable for use without departing from the spirit of the present invention. Preferably, the epoxy adhesive 180 includes particulates so as to render the composition thixotropic properties, and to otherwise prevent sagging or running of the composition. The adhesive composition 180 may be self-curing, or may require heat treatment to permanently set the composition.

The invention further provides methods of reliably curing bundle assemblies after application of an adhesive 180 to the tubes 12 and baffles 25, 25'. The inventors have discovered that the curing of the adhesive 180 is a critical aspect of the durability of a finished bundle, both in-plant, in transit, and in use upon installation into a heat exchanger shell. While the selection of the adhesive 180 provides some information as to its curing requirements, there are many variables that arise upon application of the adhesive 180 to the tubes 12 and baffles 25, 25' of a bundle assembly that make reliable curing a challenging problem. For example, the size of the adhesive bead, the amount and location of the adhesive within each assembly, the size of the assembly, the efficiency and configuration of the curing equipment, the configuration of the bundle assemblies and respective orientations of each, the surface condition of materials in the assemblies and the nature and thermal properties of the tube and baffle materials are all variables that affect the curing of adhesive applied within a bundle assembly. The inventors have developed methods of monitoring the curing of the adhesive, as well as methods of heat treatment that ensure complete curing for particular bundle assemblies.

For example, in the assembly previously described herein, adhesive Product 9432NA is used in combination with composite baffles and copper tubes, the adhesive bead having a width of from about 1 mm to about 5 mm and a height of about 1 mm to about 2 mm. In that example, heat curing of the bundle in an oven at less than 400 degrees F. for less than 5 hours resulted in a fully cured adhesive bond that can withstand vibration and movement in even the harshest shipping conditions, as well as in-use vibration and movement once placed in the shell of a heat exchanger.

Additionally, application of Product 9432NA or other thixotropic, minimally expending epoxies to tubes and baffles is novel because that adhesive is specified and known only for commercial use in surface to surface bonding of 2 substrates held in contact (such as by clamping) until curing at through the application of heat is accomplished.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. Apparatus for aligning and affixing assembled tubes and baffles in a heat exchanger bundle assembly, said apparatus comprising:

a first end plate including means for engaging a first end of a first tube and a first end of a second tube in a heat exchanger bundle assembly;

a second end plate including means for engaging the opposite end of each of the first tube and the second tube; and pressure applying means for applying force to the first end of each of the first tube and second tube and also applying force to the second end of each of the first tube and second tube so as to align each of the first tube and second tube along a preselected longitudinal axis of the bundle assembly and to permit alignment of at least one baffle of the bundle assembly in substantially perpendicular orientation to the longitudinal axis, wherein:

the first end plate comprises at least one aperture that corresponds with at least one tube opening in at least one tube of the bundle assembly;

the pressure applying means comprises at least one rod for insertion through the at least one aperture in the first end plate and the corresponding tube opening of the tube of the bundle assembly, the rod including means for preventing the entire rod from passing through the at least one aperture; and the second end plate comprises at least one aperture that corresponds with the at least one aperture in the first end plate and the at least one tube opening;

wherein the first end plate and second end plate are removably attached on opposite ends of the bundle assembly by the rod, and wherein the rod exerts force on the first and second end plates to align the tubes and baffles in substantially parallel orientation to the longitudinal axis of the bundle assembly and aligns the baffles in substantially perpendicular orientation to the longitudinal axis of the bundle assembly.

2. The apparatus of claim 1, wherein at least one of an end plate or the rod are sized and configured to permit rotation of the bundle assembly about the longitudinal axis of the bundle assembly.

3. The apparatus of claim 1, wherein the first end plate and second end plate are sized and configured to permit the bundle assembly to be placed on a surface so that no baffle or gasket touches the surface.

4. The apparatus of claim 1, further comprising an adhesive composition applied at the intersection of at least one tube and at least one baffle of the bundle assembly.

5. The apparatus of claim 4, wherein the adhesive composition is a minimally expanding adhesive composition.

6. A method of permanently fixturing a tube and baffle type heat exchanger assembly, the method comprising the steps of:

providing the apparatus of claim 1;

providing an adhesive dispensing apparatus having at least one nozzle configured for controlled dispensing an adhesive composition from an open end of the nozzle;

dispensing the adhesive composition through the dispensing apparatus while simultaneously rotating the bundle assembly about the longitudinal axis, so as to dispense adhesive composition onto a predetermined area of the bundle assembly without significantly increasing the overall outer dimensions of the bundle assembly.

7. The method of claim 6, wherein the adhesive dispensing apparatus comprises at least two dispensing nozzles, and wherein the space between the open ends of the dispensing nozzles is sufficient to permit straddling of the baffle so as to allow simultaneous dispensing of the adhesive composition onto both sides of the baffle.

8. The method of claim 6, further comprising the step of heat curing the adhesive composition without removing the pressure applying means.

9. Apparatus for aligning and affixing assembled tubes and baffles in a heat exchanger bundle assembly, said apparatus comprising:

a first end plate including means for engaging a first end of a first tube and a first end of a second tube in a heat exchanger bundle assembly;

a second end plate including means for engaging the opposite end of each of the first tube and the second tube; and pressure applying means for applying force to the first end of each of the first tube and second tube and also applying force to the second end of each of the first tube and second tube so as to align each of the first tube and second tube along a preselected longitudinal axis of the bundle assembly and to permit alignment of at least one baffle of the bundle assembly in substantially perpendicular orientation to the longitudinal axis wherein;

the first end plate comprises at least one aperture that corresponds with at least one tube opening in at least one tube of the bundle assembly;

the pressure applying means comprises at least one rod for insertion through the at least one aperture in the first end plate, the rod including means for preventing the entire rod from passing through the at least one aperture; and the second end plate comprises at least one aperture that corresponds with the at least one aperture in the first end plate and the at least one tube opening;

wherein the first end plate and second end plate are removably attached on opposite ends of the bundle assembly by the rod, and wherein the rod exerts force on the first and second end plates to align the tubes and baffles in substantially parallel orientation to the longitudinal axis of the bundle assembly and aligns the baffles in substantially perpendicular orientation to the longitudinal axis of the bundle assembly;

wherein the first end plate and second end plate are sized and configured to permit the bundle assembly to be placed on a surface so that no baffle or gasket touches the surface and wherein the first end plate and second end plate each comprise an arcuate peripheral edge configured and disposed to contact the surface.

10. The apparatus of claim 9, wherein the surface is comprised of the arcuate surfaces of two opposed cylindrical rollers, each roller having a longitudinal axis that is substantially parallel to the longitudinal axis of the opposite roller.

11. Apparatus for aligning and affixing assembled tubes and baffles in a heat exchanger bundle assembly, said apparatus comprising:

a first end plate including means for engaging a first end of a first tube and a first end of a second tube in a heat exchanger bundle assembly, the first and second tubes configured to transport a fluid for use in a heat exchange operation;

a second end plate including means for engaging the opposite end of each of the first tube and the second tube; and pressure applying means for applying force to the first end of each of the first tube and second tube and also applying force to the second end of each of the first tube and second tube so as to align each of the first tube and second tube along a preselected longitudinal axis of the bundle assembly and to permit alignment of at least one baffle of the bundle assembly in substantially perpendicular orientation to the longitudinal axis, wherein:

the first end plate comprises at least one aperture defined and surrounded by the first end plate that corresponds with at least one tube opening in at least one tube of the bundle assembly;

the pressure applying means comprises at least one rod for insertion through the at least one aperture in the first end plate and the corresponding tube opening of the tube of the bundle assembly, the rod including means for preventing the entire rod from passing through the at least one aperture; and the second end plate comprises at least one aperture defined and surrounded by the first second end plate that corresponds with the at least one aperture in the first end plate and the at least one tube opening;

wherein the first end plate and second end plate are removably attached on opposite ends of the bundle assembly by the rod, and wherein the rod exerts force on the first and second end plates to align the tubes and baffles in substantially parallel orientation to the longitudinal axis of the bundle assembly and aligns the baffles in substantially perpendicular orientation to the longitudinal axis of the bundle assembly.

* * * * *